US006625506B1

(12) United States Patent
Yeh

(10) Patent No.: US 6,625,506 B1
(45) Date of Patent: Sep. 23, 2003

(54) DECORATIVE FLOWER WITH LIGHTING AND VOICE MESSAGE

(76) Inventor: Thomas Yeh, 10F, No. 97, Sec. 2, Nan-Kang Rd., Taipei (TW)

( * ) Notice: Subject to any disclaimer, the term of this patent is extended or adjusted under 35 U.S.C. 154(b) by 0 days.

(21) Appl. No.: 09/533,793

(22) Filed: Mar. 24, 2000

(51) Int. Cl.[7] ..... A41G 1/00; G10L 21/00
(52) U.S. Cl. ..... 700/94; 428/24; 704/272
(58) Field of Search ..... 428/24; 704/272; 40/455, 124.01, 334, 538; 700/94

(56) References Cited

U.S. PATENT DOCUMENTS 4,910,647 A * 3/1990 Gong ..... 362/122
5,648,129 A * 7/1997 Lee et al. ..... 428/24
6,253,183 B1 * 6/2001 Boucard ..... 704/272

* cited by examiner

*Primary Examiner*—Forester W. Isen
*Assistant Examiner*—Brian Pendleton
(74) *Attorney, Agent, or Firm*—Troxell Law Office PLLC

(57) ABSTRACT

A decorative flower with lighting and voice message is enclosed. The decorative flower includes a shaft having a tapering lower end, a middle section, and a top section having an enlarged inner space. A flower part having a number of artificial petals is encircled to the top section of the shaft to form a flower shape. A printed circuit board is mounted inside the middle section of the shaft. A microphone, a recording button and a playing button are arranged inside the middle section and electrically connected to the printed circuit board separately. A battery arranged inside the shaft for supplying power. A speaker is arranged in the enlarged inner space of the top section, and a light emitting element is mounted on the top end of the top section. Both of the speaker and the light emitting element are electrically connected to the printed circuit board. A ball pen refill is arranged inside the tapering lower end of the shaft, and the tip of the ball pen refill protrudes out of the shaft. Furthermore, a clip or a brooch is mounted on the shaft.

5 Claims, 3 Drawing Sheets

DECORATIVE FLOWER WITH LIGHTING AND VOICE MESSAGE

BACKGROUND OF THE INVENTION

1. Field of the Invention

The present invention generally relates to a decorative flower, and in particular to a decorative flower can memorize, play voice message and lighten.

2. Description of the Prior Art

Fresh flowers are usually sent as a present on special days to show someone's feelings and thoughts. For example, a cluster of roses in Valentine means "I love you", carnations in Mother's Day means gratitude, or sending flowers on graduation, birthday party, or when finishing a performance conveys congratulation. That is a reason why in some special holidays the price of the fresh flowers always rises doubled or tripled. However, the preservation period of the fresh flowers is not very long, usually after 5 to 10 days the fresh flowers will start withering, the heart of the flower sender can not be kept forever. But sending a cluster of artificial flowers for the preservation reason, the artificial flowers are not so beautiful and fragrant as the flesh flowers, and it seems that the flower sender doesn't have enough sincerity. Besides, no matter sending any kind of flowers, the truest heart feelings of the flower sender usually still can not be conveyed completely from the flowers.

It is thus desirable to have a decorative flower with lighting and voice message for overcoming the problems discussed above. The present invention provide a decorative flower with lighting and voice message which can record voice message from the flower sender, then play the voice message out to the flower receiver, the true feelings can be conveyed completely and preserved for a long time

SUMMARY OF THE INVENTION

Accordingly, the object of the present invention is to provide a decorative flower that can memorize, play voice message and lighten.

The other object of the present invention is to provide a decorative flower may be used as a ball pen.

One more object of the present invention is to provide a decorative flower that is easily to carry.

To achieve the above objects, in accordance with the present invention, there is provided a decorative flower with lighting and voice message comprising a shaft having a tapering lower end, a middle section, and a top section having an enlarged inner space. A flower part having a number of artificial petals is encircled to the top section of the shaft to form a flower shape. A printed circuit board is mounted inside the middle section of the shaft. A microphone is electrically connected to the printed circuit board. A recording button and a playing button are electrically connected to the printed circuit board separately. A battery receptacle is formed under the printed circuit board for receiving batteries therein for supplying power to the printed circuit board.

The top section of the shaft is concealed inside the flower part. A speaker is arranged in the enlarged inner space of the top section, and a light emitting element is mounted on the top end of the top section. Both of the speaker and the light emitting element are electrically connected to the printed circuit board. When a user presses the recording button, the voice of the user may go through the microphone hole, be recorded and memorized by the printed circuit board. When pressing the playing button, through the controlling of the printed circuit board, the voiced memorized will be played by the speaker, and the light emitting element will lighten or flash at the same time.

Furthermore, a ball pen refill is arranged inside the tampering lower end of the shaft, and the tip of the ball pen refill protrude out of the shaft for making the present invention become a ball pen.

Besides, a clip is mounted on the shaft for the present invention may be clipped on the pocket or handbag of the user for easily carrying and decoration. Alternatively, the clip may be replaced by a brooch.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
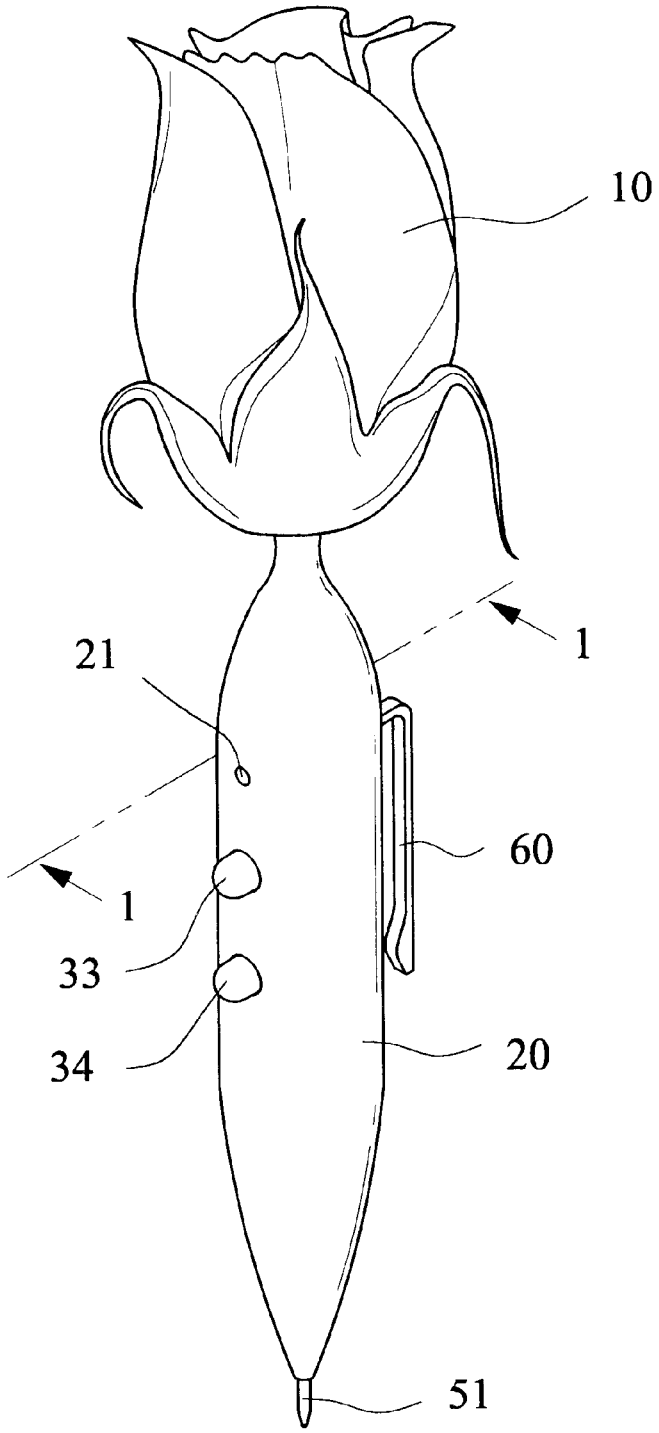
FIG. 1 is a perspective view of a decorative flower with lighting and voice message constructed in accordance with a first embodiment of the present invention.

With reference to the drawings and in particularly to FIG. 1, it shows a decorative flower with lighting and voice message constructed in accordance with a first embodiment of the present invention comprising a shaft 20 having a tapering lower end, a middle section, and a top section having an enlarged inner space. A flower part 10 having a number of artificial petals is encircled to the top section of the shaft 20 to form a flower shape. The flower part 10 may be made of clothes or soft plastics, such as flannel or corduroy, to form a flower shape, such as rose or carnation.

Figure 2:
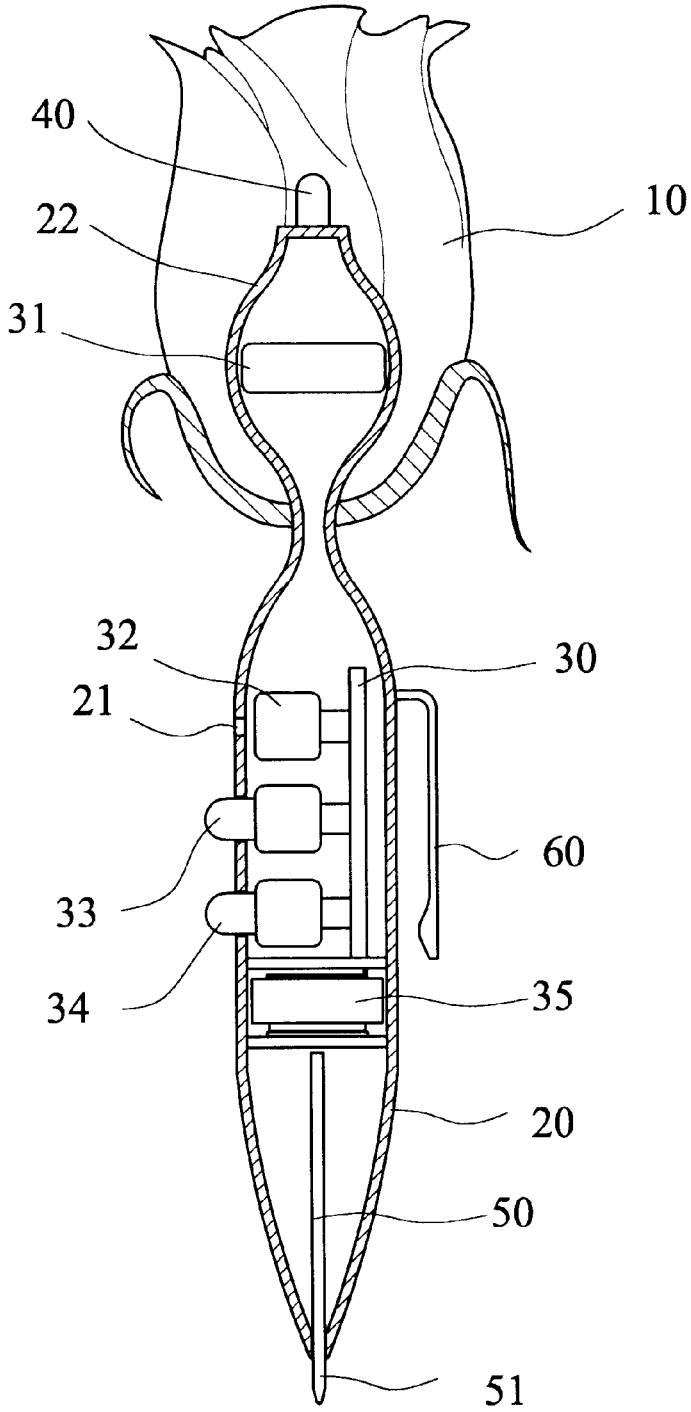
FIG. 2 is a cross-sectional view of a decorative flower with lighting and voice message in accordance with the first embodiment of the present invention taken along line 1—1 of FIG. 1.

FIG. 2 shows a cross-sectional view of the decorative flower with lighting and voice message, taken along line 1—1 of FIG. 1. According to FIG. 1 and FIG. 2, a printed circuit board 30 is mounted inside the middle section of the shaft 20. A controlling circuit for controlling recording, memorizing, playing, and lightening is arranged on the printed circuit board 30 by means of well-known printed circuit layout technique. A microphone 32 is electrically connected to the printed circuit board 30 and aimed at a corresponding microphone hole 21 formed on the shaft 20 for the voice going through the microphone hole 21 and being received by the microphone 32. A recording button 33 and a playing button 34 are electrically connected to the printed circuit board 30 separately and protruded out of the shaft from the corresponding holes (not shown) formed on the shaft 20 for easily controlling. A battery receptacle is formed under the printed circuit board 30 for receiving a battery 35 therein for supplying power to the printed circuit board 30.

The top section 22 of the shaft 20 is concealed inside the flower part 10. A speaker 31 is arranged in the enlarged inner space of the top section 22 and electrically connected to the printed circuit board 30. A light emitting element 40 is mounted on the top end of the top section 22 and electrically connected to the printed circuit board 30. When a user presses the recording button 33, the voice of the user may go through the microphone hole 21, be received by the microphone 32 and be recorded and memorized by the printed circuit board 30. When pressing the playing button 34, through the controlling of the printed circuit board 30, the voice which has been memorized will be played by the speaker, and the light emitting element 40 will lighten or flash at the same time.

A ball pen refill 50 is arranged inside the tampering lower end of the shaft 20. The tip 51 of the ball pen refill 50 protrudes out of the shaft through a hole formed on the button end of the shaft 20, for making the present invention become a ball pen.

Besides, a clip 60 is mounted on the opposite side corresponding to the microphone hole 21 of the shaft 20 for the present invention being clipped on the pocket or handbag of the user for easily carrying and decoration.

Figure 3:
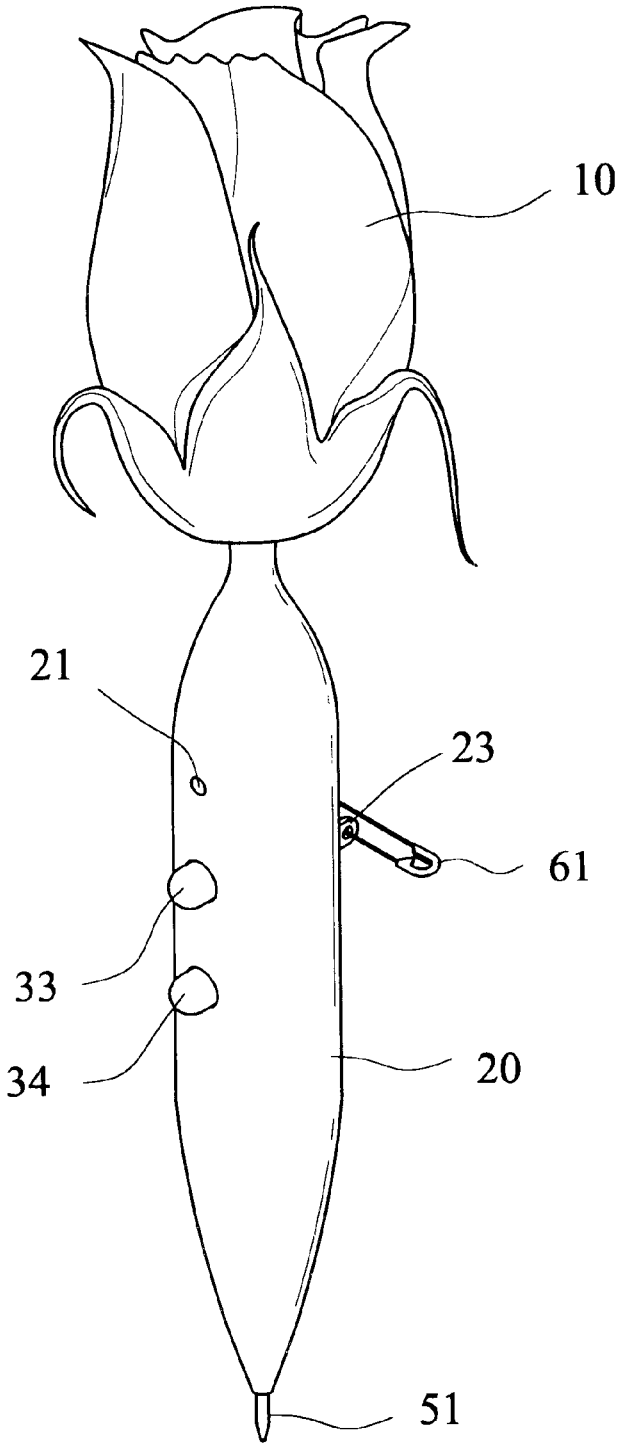
FIG. 3 is a perspective view of a decorative flower with lighting and voice message constructed in accordance with a second embodiment of the present invention.

FIG. 3 shows a decorative flower with lighting and voice message constructed in accordance with a second embodiment of the present invention. In this embodiment, the clip 60 will be replaced by a brooch 61. The brooch 61 is fixed on a ring 23 formed on the opposite side corresponding to the microphone hole 21 of the shaft 20, for the present invention being pinned on clothes or handbags for decoration.

Although the present invention has been described with respect to the preferred embodiments, it is contemplated that a variety of modifications, variations and substitutions may be done without departing from the scope of the present invention that is intended to be defined by the appended claims.

What is claimed is:

1. A decorative flower with lighting and voice message comprising:

a shaft having a tapering lower end, a middle section, and a top section having an enlarged inner space;

a flower part having a number of artificial petals and encircled to the top section of the shaft;

a printed circuit board mounted inside the middle section of the shaft;

a microphone mounted inside the middle section of the shaft and electrically connected to the printed circuit board;

a recording button mounted inside the middle section of the shaft and electrically connected to the printed circuit board for controlling recording;

a playing button mounted inside the middle section of the shaft and electrically connected to the printed circuit board for controlling playing;

a speaker mounted in the enlarged inner space of the top section of the shaft and electrically connected to the printed circuit board;

a light emitting element mounted in the top end of the top section of the shaft and electrically connected to the printed circuit board; and a battery arranged inside the shaft under the printed circuit board for supplying power thereto.

2. A decorative flower with lighting and voice message as claimed in claim 1, wherein the shaft further comprises a plurality of through holes corresponding to the microphone, recording button and playing button.

3. A decorative flower with lighting and voice message as claimed in claim 1, further comprising a ball pen refill arranged inside the tapering lower end of the shaft and the tip of the ball pen refill protruding out of the shaft from the bottom end.

4. A decorative flower with lighting and voice message as claimed in claim 1, further comprising a clip mounted on the shaft.

5. A decorative flower with lighting and voice message as claimed in claim 1, further comprising a ring formed on the shaft and a brooch fixed on the ring.

* * * * *